US006755749B2

(12) United States Patent
Stengel

(10) Patent No.: US 6,755,749 B2
(45) Date of Patent: Jun. 29, 2004

(54) FREE-FALL TOWER FOR A ROLLER COASTER

(76) Inventor: Werner Stengel, Minorstr. 19, 81477 München (DE)

( * ) Notice: Subject to any disclaimer, the term of this patent is extended or adjusted under 35 U.S.C. 154(b) by 118 days.

(21) Appl. No.: 09/949,482

(22) Filed: Sep. 7, 2001

(65) Prior Publication Data

US 2002/0103033 A1 Aug. 1, 2002

Related U.S. Application Data

(60) Provisional application No. 60/231,270, filed on Sep. 8, 2000.

(51) Int. Cl.[7] ..... A63G 31/04
(52) U.S. Cl. ..... 472/50; 472/29; 472/131
(58) Field of Search ..... 472/49, 50, 131, 472/136, 29; 104/53, 77, 78

(56) References Cited

U.S. PATENT DOCUMENTS

| | | | | |
|---|---|---|---|---|
| 2,221,215 A | * | 11/1940 | Eyerly | 182/141 |
| 5,628,690 A | * | 5/1997 | Spieldiener et al. | 472/131 |
| 5,893,802 A | * | 4/1999 | Bohme | 472/131 |
| 5,957,779 A | * | 9/1999 | Larson | 472/131 |
| 6,083,111 A | * | 7/2000 | Moser et al. | 472/131 |
| 6,315,674 B1 | * | 11/2001 | Slade et al. | 472/131 |

FOREIGN PATENT DOCUMENTS

| | | |
|---|---|---|
| DE | 91 04 204 | 6/1991 |
| DE | 197 24 273 | 6/1997 |
| DE | 198 09 641 | 3/1998 |
| DE | 197 24 275 A 1 | 12/1998 |
| WO | WO 99/04875 | 2/1999 |

OTHER PUBLICATIONS

EPO Search Report for European Application No. 01111924.5.

* cited by examiner

*Primary Examiner*—Kien T. Nguyen
(74) *Attorney, Agent, or Firm*—Renner, Otto, Boisselle & Sklar, LLP

(57) ABSTRACT

The invention relates to a free-fall tower for a roller coaster, comprising an approximately or a precisely vertical rail system for a passenger unit, which moves from the lower end to the upper end of said tower, from where the passenger unit can freely fall down to subsequently reach said roller coaster course. In the region of the upper end of said tower, the fixedly secured passenger unit is rotated around an approximately or a precisely vertical axis to allow the passenger unit to freely fall down on another rail of said tower. This results, in combination with a roller coaster course, particularly in combination with a second tower of similar construction, in new, eventful ride effects.

12 Claims, 4 Drawing Sheets

FREE-FALL TOWER FOR A ROLLER COASTER

This application claims the benefit of Provisional application No. 60/231,270 filed Sep. 8, 2000.

The invention relates to a free-fall tower for a roller coaster according to the kind set forth in the preamble of claim 1.

One understands under the term a free-fall tower an approximately or a precisely perpendicular tower, having at least one side face provided with approximately or precisely perpendicular rails. Individual wagons or a train, in the following also referred to as "passenger unit", are "shot" on said rails by means of a catapult-like acceleration until they reach the upper end of the tower, where the climbing speed becomes zero; then the passenger units fall down backwards in a free-fall and are stopped above the ground as smooth as possible. With such free-fall towers only a sort of shuttle-operation, is possible, namely the transport up to the upper end of the tower and subsequently the free-fall down to the initial starting point at the bottom of the tower.

Furthermore it is already known to combine a free-fall tower with a roller coaster, i.e. with a ride, in which the passenger units run through ascending and descending gradients on tracks of different geometry such as, for example, straight courses, curves, loops, helices etc. At Sahara Hotel in Las Vegas, Nev. USA, in the area of "Nascar Cafe", a roller coaster called "Speed: The Ride" is operated, with which a passenger unit is "shot" out of the hotel by means of a catapult up to the upper end of a free-fall tower; at the highest point at which the speed of the passenger unit becomes zero, the passenger unit immediately falls freely downwards and then passes through a route of different geometrical curves until it finally reaches the initial starting point. Accordingly, the course is not a closed loop, and also here only a sort of shuttle operation between the station of departure and the upper end of the free-fall tower is possible.

Similar roller coasters with free-fall towers are operated in Arlington, Tex., and in Eureka, Mo., under the name "Mr. Freeze".

What is disadvantageous about this embodiment of a free-fall tower with combined roller coaster is the shuttle operation used, since, generally, the free fall and the subsequent ride via the roller coaster only occur in backward direction. Therefore, attempts are being made to find additional variations, such as changes in the direction of motion, diversification of the course design etc.

It is an object of the invention to provide a free-fall tower for a roller coaster of the type indicated which obviates the above-mentioned disadvantages. Particularly, it is intended to propose a free-fall tower which is offers additional thrills and which enables a very diversified and especially variable design of the course, even on relatively small ground space.

This object is solved in accordance with the invention by the features set forth in the characterizing part of claim 1. Useful embodiments are defined by the features set forth in the sub-claims.

The advantages obtained by the invention are based on the functional operation as follows: As usual up until now, a passenger unit is positioned at the upper end of an approximately or a precisely perpendicular free-fall tower by means of a lifter, by linear motors or by a catapult launch. However, the respective wagons are constructed to be used for an "ordinary ride", i.e. the passengers sit upright in the wagons so that they lie on their backs in their seats in forward direction at the end of this perpendicular ascent and look upwards. The passengers are, of course, secured in their seats by a safety system, e.g. a safety bar.

At the end of this ascent, if the kinetic energy of the passenger unit and, thus, its speed becomes zero, i.e. the free fall would begin without additional measures, a redundant brake system is activated and the passenger unit is secured so that the passengers laying on their backs in their seats look upwards.

After a period of time, the length of which can be varied, owing to which the tension is additionally intensified, the passenger unit is rotated around an approximately or a precisely perpendicular axis. This rotation can be performed, for example, by the passenger unit with regard to the rails or by the rail with the passenger unit with regard to the structure of the tower. According to a preferred embodiment, however, especially for structural and safety reasons, the entire upper region of the tower, including the rail system and fixed passenger units, is rotated around the vertical axis. To do so, all that is required is to separate the rails, locked to each other, at an intersecting point of the tower so that the upper region of the tower, including rail and passenger unit, is rotated, while the lower part of the tower, including its rails, remains stationary.

After the rails of the rotatable upper part have been again locked in the new position with the rails of the lower, stationary part of the tower, the brakes will again be released—likewise after a variable period of time—and the passenger unit falls approximately or precisely perpendicular downwards in free-fall backwards at the tower. At the lower end of the tower, the rails merge into a roller coaster course so that the passenger unit may now run backwards through all known course configurations such as straight or curved ascending or descending inclinations, loops, helices etc.

Then, the rails can lead the passenger unit again to the same or to another tower, at which the passenger unit climbs up backwards. Energy which was lost due to friction or air resistance can again be supplied to the passenger unit, e.g. by linear motors provided at the tower or near the ground in a straight region.

As soon as the upper end of the tower has been reached, the run starts again, i.e. the passenger unit is locked by a redundant brake system, and the passengers, lying in their seats and secured by the safety bar, look downwards.

Now it is either possible to rotate the upper tower region again or to release the brake—without any rotation of the tower—so that the passenger unit falls in forward direction of this tower and now passes through the roller coaster course, including loops, helices etc., in a forward movement, as was done in a backward movement before.

This ride effect can be repeated several times or can also be terminated after having stopped at the first tower or the second tower, and the passenger unit can be returned via the drop path and a brake system to the initial starting point so as to form a closed loop.

If more than one tower is used, e.g. two towers, it is not required to ride from one tower to the other, rather travelling actions can also be executed, in between times, to the same tower and then again to a second tower.

Both the direction of rotation of the upper part of the, or each, tower as well as the angle of rotation may vary. If a tower is provided, e.g., with four rail systems, the upper tower section can be rotated by 90°, 180°, 270° or 360°, i.e. at angular steps of 90° each time, wherein it is also possible to combine a number of angular steps.

This results in a variety of riding options which can be used for this roller coaster.

In particular, the duration of the run can be varied, for example by passing through a certain part of the course several times. If only few people are waiting, the run can be prolonged, whereas it can be reduced, if many people are waiting.

As the passenger unit cannot generally be stopped at the upper tower end with pinpoint accuracy, the rail on top of the tower is designed to be extended, and the intersecting point of the rails between the lower, stationary and the upper rotatable section of the tower will be positioned below the passenger unit at the utmost lower point possible.

As the passenger unit can only fall downwards when the rails at the tower or towers are locked, the roller coaster never runs with an open rail, and only one passenger unit, respectively, is located in each block. A block is to be understood as a part of the course, in which for safety reasons only one single passenger unit is allowed to be located.

Thus, all safety specifications relating to roller coasters are met.

Already by employing one single tower, new ride effects in combination with free fall and forward and backward movements can be realized in a closed-loop roller coaster course, but even a greater number are achieved if two or more towers are used. At the same time, the ride effects of two known amusement rides may be combined, namely a free-fall tower on the one hand and a roller coaster on the other hand, and new and better effects are achieved, as the free fall can now be performed either forwards, backwards, or in the lying position.

A roller coaster with integrated free-fall tower in accordance with the invention requires less space in the ground plan, since many effects, particularly the essential effects, take place at the precisely or approximately vertical tower. Accordingly, dead corners of property in amusement parks can also be used for this amusement ride.

In contrast to regular roller coasters, all courses may be passed through several times, and, upon appropriate rotation of the tower or each tower, even in alternating backward and forward movements.

The block brakes required for conventional roller coasters are only still necessary in the area of the station, as the tower or tower fulfill the same function.

In the following, the invention will be explained in more detail by means of embodiments with regard to the appertaining, diagrammatic drawings, in which.

Figure 1:
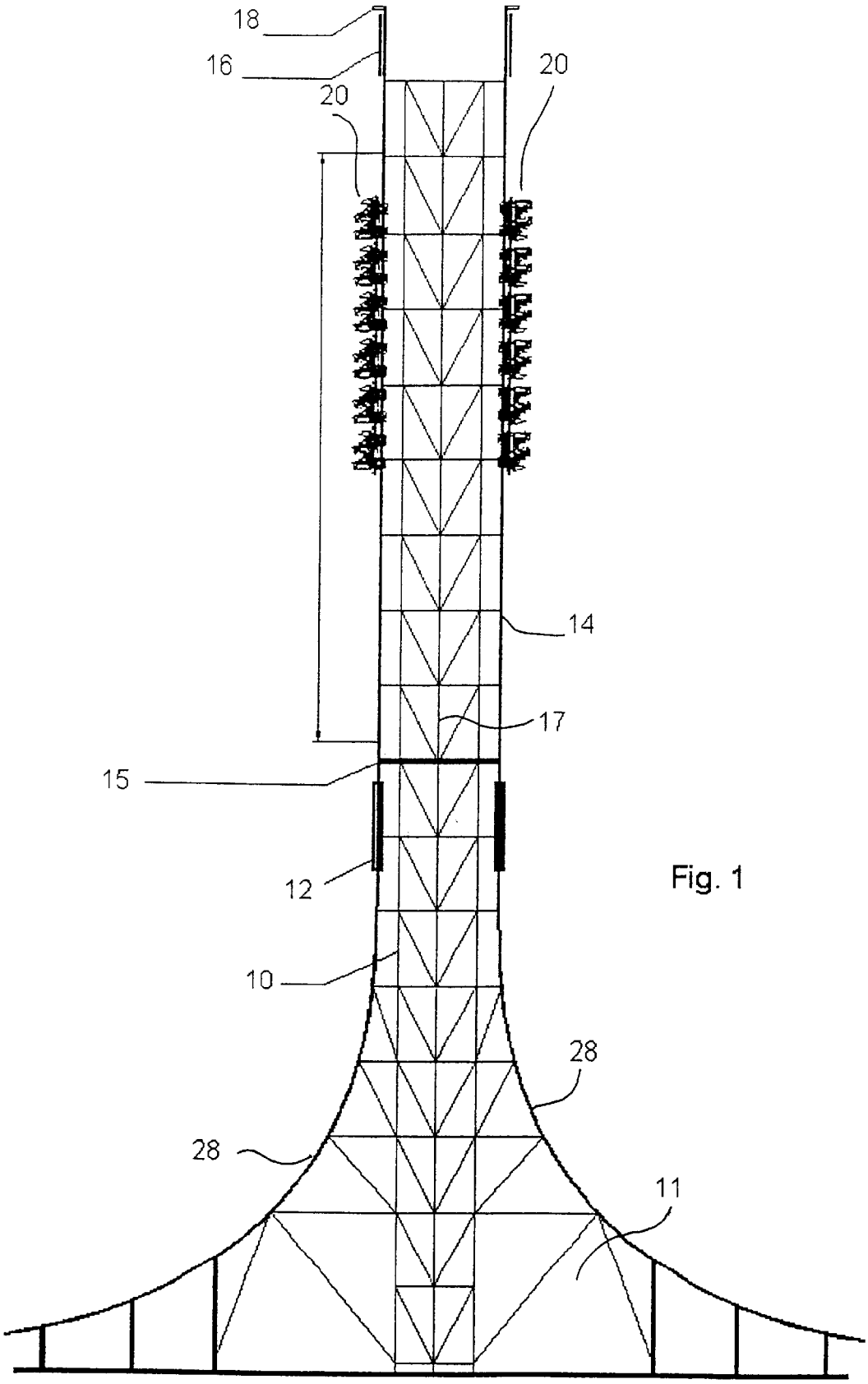
FIG. 1 is a side view of a free-fall tower.

A tower, generally indicated in FIG. 1 by reference number 10, is formed by, e.g., a lattice or framework construction and comprises a wide base 11, which runs into a slim end section 14. The side faces of the tower 10 are provided with a commercially available rail system 28 (also see FIG. 2), FIG. 1 just showing one rail system 28 on the left and right, respectively. It is, however, also possible to provide further rail systems 28 at the front and rear side of the tower 10.

A single wagon or a train 20, only referred to in the following as "passenger unit", can ride to the upper end of the tower 10 on the rail system 28. The kinetic energy required for this movement can be generated on a pre-connected, downwardly sloping or free-fall course by means of lifters, linear motors, or a catapult.

In case the kinetic energy hereby made available does not suffice, linear motors 12 can be provided at approximately the middle of tower 10, which take over further transport of the passenger unit 20 in the end region of the vertical course.

Shown on the right of FIG. 1 is a passenger unit 20, in this case a train, which approached the tower 10 in backward direction, i.e. in the upper end position at the tower 10, the passengers look downwards.

The train 28 on the left of the tower 10 approached the tower in the forward direction, i.e. the passengers look upwards in the upper end position.

At the upper tower end, the rail system 28 is provided with an emergency brake 16 and a stopper 18, which together limit the movement of a passenger unit 20.

The upper region of the tower 10, indicated by the reference numeral 14, is separated from the lower part at a plane of rotation 15. This upper region 14 can be rotated around the vertical, center tower axis 17 by means of in successive steps of 90° each.

Figure 2:
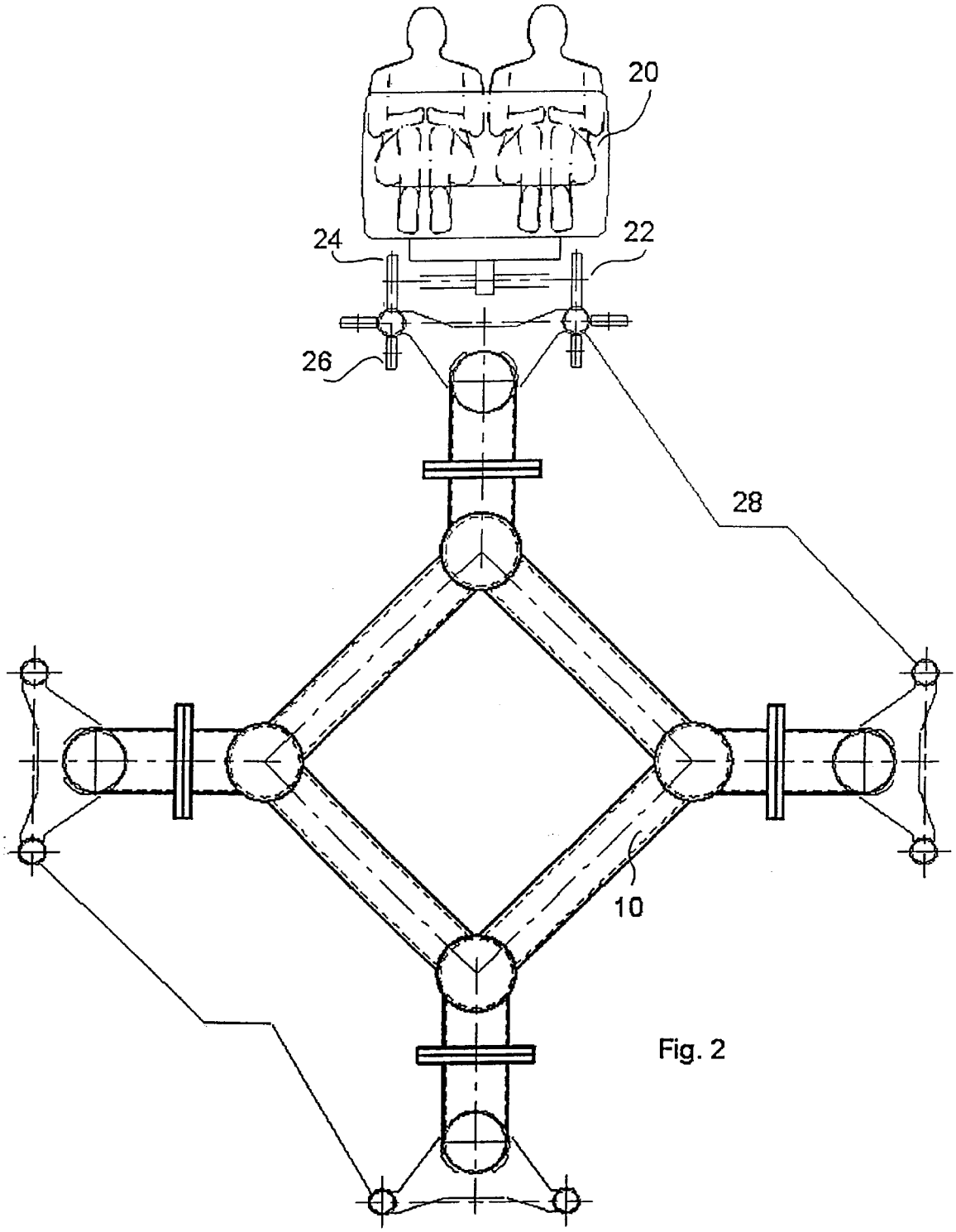
FIG. 2 is a top view of the tower with one passenger unit.

As can be seen from the horizontal cut through the upper part 14 of the tower 10 in FIG. 2, the tower 10 has a square ground plan, a rail system 28 being located at each of the four corners of said square. A passenger unit 20 having wheels 24 rotating around an axis 22 and running with counter wheels 26 can run on the rail system or each of the rail systems 28, such cooperation between the wheels 24 and the counter wheels 26 causing the rails 28 to also hold the passenger unit 20 in the perpendicular position represented in FIG. 2, in which the passengers look upwards. This position of the passenger unit 20 is also shown on the left of FIG. 1.

The passenger unit 20 moves up at the tower 10 on one of the four rail systems 28 at a high speed, e.g. after having passed a free-fall course or being shot by a catapult, optionally being supported by the linear motors 12, until it reaches the upper region 14.

At the end of the ascending course, if the speed of the passenger unit 20 is at least almost zero, a redundant brake system is activated to lock, for example, the wheels 24 of the passenger unit 20, and thereby securely fasten the passenger unit 20 in the position evident from FIG. 1.

When the tower was approached in forward direction, the passengers now, lying on their backs in their seats of the passenger unit, look up into the sky.

After a variable and adjustable period of time, the rails 28 will be released from their locking position at the plane of rotation 15, and the entire upper region 14 of the tower 10, including the fixed passenger unit 20, is rotated around the vertical axis 17 of the tower 10 in steps of 90° each, several 90° steps can also be completed immediately after each other.

The direction of rotation of the upper section 14 of the tower 10 can be changed at will, i.e. according to the illustration in FIG. 2, the region 14 with the passenger unit 20 may rotate in clockwise direction or anti-clockwise direction in individual or several successive 90° steps, to reach the next respective position indicated.

As soon as the passenger unit is in its new position, the new rail position in the region of the plane of rotation 15 is locked with the rail system 28 in the stationary lower part 11 of the tower 10; then—also after a variable, adjustable period of time—the brakes of the redundant brake system will be released and the passenger unit 20 falls down, at least at the beginning perpendicularly, at the tower 10 backwards in free fall.

In a simple embodiment, which is particularly useful if only little ground space is available, the passenger unit 20 is smoothly decelerated at the lower end of the tower 10 and then transported up again.

It is especially useful, however, to connect a rail system of a conventional roller coaster to the rail system 28 of the tower so that, for instance in the above-described case, the passenger unit 20 can move backwards along known ride designs, e.g. loops, helices, fall routes, ascents, curves, etc.

Figure 3:
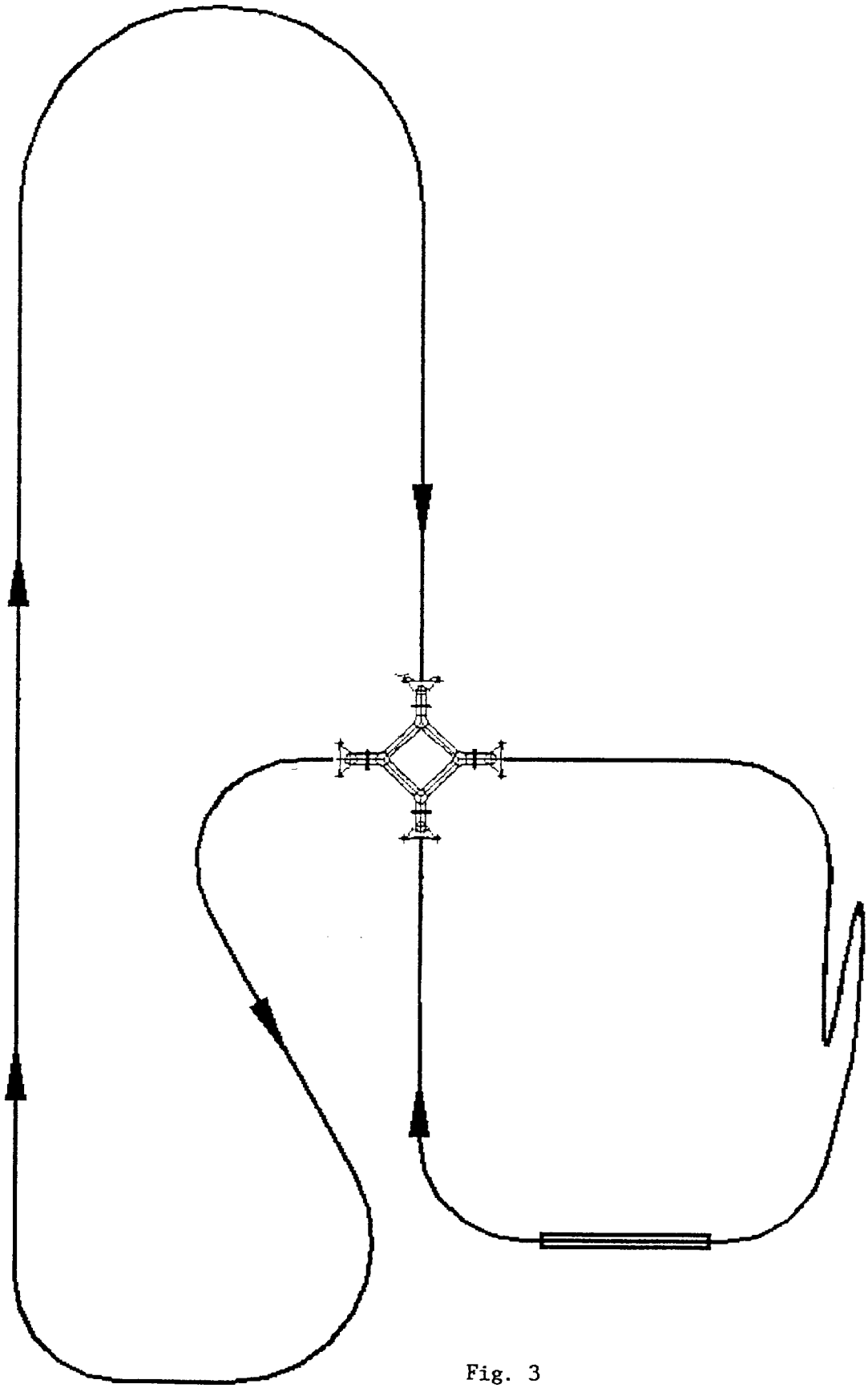
FIG. 3 is a diagrammatic view of an example for a roller coaster with one tower.

FIG. 3 shows a possible embodiment of such a roller coaster, in which a tower 10 is integrated with a rotating upper section 14.

This roller coaster course includes a station where the passengers board the passenger units 20. One passenger unit 20 is then brought up to the upper section 14 of the tower 10 by means of a lift or a linear motor or a catapult start, during phase 1 identified by a 1 in a circle, in forward direction of the passenger unit 20 on rail no. 1 of the tower 10. As already described, the passenger unit 20 is then fixedly secured in the upper section 14, which is then rotated in phase 2 towards rail no. 2. Then, the brake is released and, in phase 3, the passenger unit 20 freely falls down backwards at the tower 10, passes a loop again to the tower 10 and, if the fall energy does not suffice, is transported via a linear motor to rail no. 3 in the upper region 14 of tower 10.

Here, the passenger unit 20 will either be secured again or immediately freely fall down again so as to run again, in phase 4, through the same loop course in forward direction until it returns to rail no. 2 again. Now, phase 3 including the loop, now being referred to as phase 5, is again run through in backward direction until rail no. 3 is reached again, where the passenger unit 20 is fixedly secured.

Now, the passenger unit 20 is further rotated in clockwise direction towards rail no. 4, phase 6, and then freely falls down in forward direction to reach another rail course until, via a conventional brake in phase 7 the station is finally reached again.

Depending on the amount of people waiting, the above-described operation may also be varied; if many people are waiting, phases 4 and 5 might be skipped, for example, to obtain shorter ride periods and, thus, to attain a higher throughput.

If only few people are waiting, phases 3, 4 and 5, for example, may be repeated several times resulting in longer ride periods.

Figure 4:
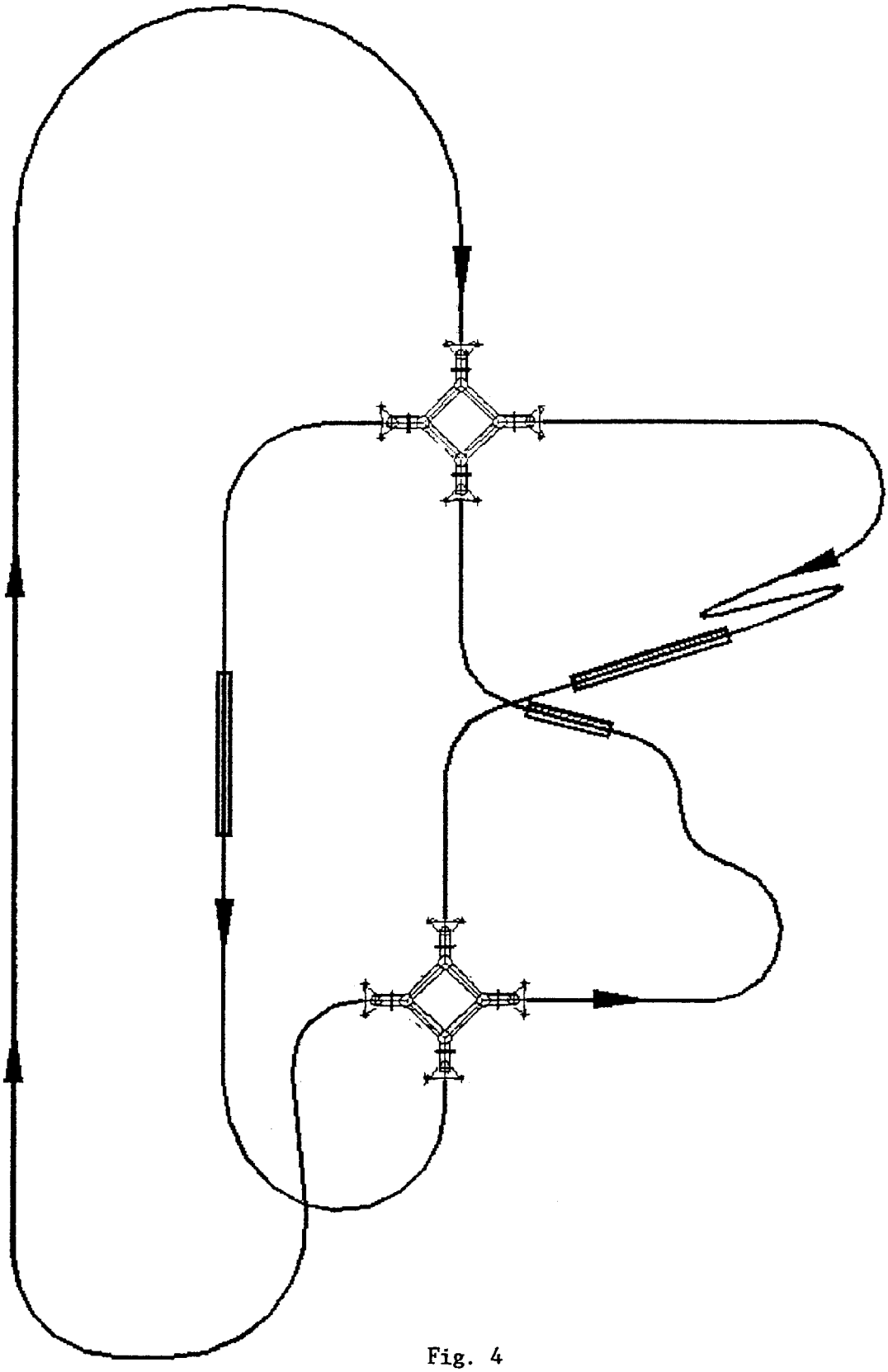
FIG. 4 is a diagrammatic view of an example for a roller coaster with two towers.

Finally, FIG. 4 shows an embodiment with two free-fall towers 10 being integrated into the roller coaster course.

Also here, the passenger unit 20 is moved in phase 1 forwards towards rail no. 1.1 in the upper region 14 of the first tower no. 1. In phase 2, section 14 of the first tower no. 1 is rotated by 90° so that the passenger unit 20 is now on rail 1.2 of tower no. 1. Then, the passenger unit 20 falls down backwards at the first tower no. 1 and runs in phase 3 through a course comprising a loop and, optionally, a linear motor to further transport the passenger unit 20 to rail no. 2.1 of the second tower no. 2. After this phase 3, the upper section 14 of the second tower no. 2 in phase 4 is rotated by 90°, so that the passenger unit is now located on rail no. 2.2 of second tower no. 2. Then passenger unit 20 freely falls down forwards and reaches, in phase 5, rail no. 1.3 of the first tower no. 1. If necessary, this course may also be provided with linear motors.

After phase 5, the upper region 14 of the first tower no. 1 is rotated by 90° in clockwise direction so that, in phase 6, rail no. 1.4 of first tower no. 1 is reached. After said phase 6, the passenger unit 20 falls down backwards, in phase 7, at the first tower no. 1 and reaches, again optionally driven by a linear motor, rail no. 2.3 of the second tower no. 2.

Now, the upper region 14 of the second tower no. 2 is rotated clockwise so that, in phase 8, rail no. 2.4 of the second tower no. 2 is reached.

In phase 9, the passenger unit 20 freely falls down forwards from this point and returns to the station via the usual brakes.

Naturally, the course according to FIG. 4 may also be combined with that according to FIG. 3, i.e. it is not always absolutely required to approach the other tower 10, rather it is also possible, at least on parts of the course, to approach another rail of the same tower 10 first before going over to the other tower 10.

As the passenger unit 20 cannot be stopped with pinpoint accuracy in the upper region 14 of the tower or of each of the towers 10, the rail system in tower 10 is designed extended, and the intersecting point 15 between the stationary section 11 and the rotating section 14 of the tower 10 is positioned as low as possible so that there is enough tolerance to fixedly secure the passenger unit 20.

As the passenger unit 20 can only fall down if the rail has been locked to the tower 10 or each of the towers 10, this roller coaster cannot be operated with open rails; in addition, it is thereby guaranteed that, in each block of the course, i.e. in each part of the course, in which only one single passenger unit should be kept, actually only one single passenger unit 20 is to be found there.

Thus, all the safety specifications relating to roller coasters are fulfilled.

After running through a drop course, but also after a catapult start, energy losses occur at the passenger unit 20 due to frictional forces and air resistance. To compensate this energy loss, energy has to be supplied, e.g. via the linear motors often mentioned above. The required supply of energy can be checked quite precisely, and can, upon need, even be controlled. It is thus ensured that only the upper rest position of the passenger unit is reached under normal operation.

Nevertheless, for safety reasons, the upper region 14 of each tower 10 is not only provided with the normal brake, but also with an emergency brake 16 as well as an end buffer 18, which serves as a stopper to avoid overshooting of the passenger unit.

It could happen that a power failure occurs at a time when a passenger unit 20 is fixedly held in the upper region 14 of a tower 10. In such a case, a stand-by unit is provided which rotates the upper region 14 of said tower 10 into an angular position, from which the passenger unit 20 can reach the station via the appertaining rail system 28 after having released the brakes.

Another dangerous situation is if the power fails during the ride, with the result that energy cannot be supplied to the passenger unit 20 via the linear motors to replace the lost energy. Consequently, the passenger unit 20, after having passed through the ascending course at the tower 10, might not reach the brake provided in the upper region 14 any more. The passenger unit 20 would then freely fall downwards and come to rest at the bottom of a curve of the roller coaster course in a pendulum fashion. As such a point is generally near the ground, the passengers can be easily rescued from the passenger unit.

Alternatively, the passenger unit 20 at the tower 10 can be retained in a lower position in the brake region above the intersecting point 15. Here, too, the upper region 14 of the tower 10 is rotated by a stand-by unit into a position enabling the passengers to safely reach the station.

If in any of the cases described above the potential energy of the passenger unit 20 does not suffice to safely reach the station, the brake retaining the passenger unit 20 in the upper region 14 of the tower 10 can be released so that the passenger unit 20 can freely fall down and come to rest near the ground in a pendulum fashion.

Alternatively, the passenger unit might also be elevated at the tower 10 by means of a hoisting winch (not shown) driven by the above-mentioned stand-by unit, be retained in the braking region of the upper region 14, and then released from the brake so that the station can be safely reached due to the longer dropping distance.

I claim:

1. A free-fall tower for a roller coaster, the tower having an approximately vertical axis and comprising:

a lower tower section and an upper tower section arranged for approximately vertical movement of a passenger unit from the lower tower section to the upper tower section and then from the upper tower section to the lower tower section, the lower tower section including at least two rail sections, and the upper tower section being configured to receive the passenger unit from one of the two rail sections of the lower tower section for movement to an elevated position, and then to direct the passenger unit for free-fall from the elevated position to the other one of the two rail sections of the lower tower section;

wherein the upper tower section has at least one rail section for guided movement of the passenger unit to the elevated position, and the upper tower section is rotatable about the approximately vertical axis of the tower between at least two relatively rotated positions respectively aligning the rail section of the upper tower section with the two rail sections of the lower tower section, whereby the passenger unit can move from one of the two rail sections of the lower tower section to the rail section of the upper tower section when the upper tower section is in one of the two relatively rotated positions, and then the upper tower section can be rotated with passenger unit on the rail section thereof to the other one of the two relatively rotated positions for descending movement of the passenger unit to the other of the two rail sections of the lower tower section.

2. The free-fall tower of claim 1, wherein the at least two rail sections of the lower tower section include four rail sections.

3. The free-fall tower of claim 2, wherein the at least one rail section of the upper tower section includes four rail sections.

4. The free-fall tower of claim 3, wherein the four rail sections of the upper tower section and the four rail sections of the lower tower section are each arranged in a circle and are circumferentially equally spaced apart.

5. The free-fall tower of claim 4, wherein provision is made for holding the passenger unit stationary in the upper tower section during rotation of the upper tower section.

6. The free-fall tower of claim 2, wherein the four rail sections of the lower tower section are arranged in a circle and are circumferentially equally spaced apart.

7. The free-fall tower of claim 1, wherein provision is made to rotate the upper tower section in the event of a power failure.

8. The free-fall tower of claim 1, wherein the upper and lower tower sections include respective frameworks to which the respective rail sections are attached, the frame work of the upper tower section is rotatable relative to the framework of the lower tower section.

9. A roller coaster comprising a passenger unit and a roller coaster course along which the passenger unit moves, the roller coaster course including first and second course sections having respective rail sections, and a free-fall tower disposed along the roller coaster course between the first and second course sections: the tower having an approximately vertical axis and including:

a lower tower section and an upper tower section arranged for approximately vertical movement of the passenger unit from the lower tower section to the upper tower section and then from the upper tower section to the lower tower section, the lower tower section including at least two rail sections, and the upper tower section being configured to receive the passenger unit from one of the two rail sections of the lower tower section for movement to an elevated position, and then to direct the passenger unit for free-fall from the elevated position to the other one of the two rail sections of the lower tower section, with the two rail sections of the lower tower section respectively connected to the rail sections of the first and second course sections.

10. The roller coaster of claim 9, further comprising a second free-fall tower disposed along the roller coaster course between a third course section having a rail section and either one of the first and second course sections.

11. The roller coaster of claim 9, wherein the at least two rail sections of the lower tower section include four rail sections, and at least one of the four rail sections is connected to a rail section of a third course section.

12. The roller coaster of claim 9, wherein the rail section of at least one of the course sections includes as a part thereof one or more of a straight section, a curved section, an ascending section, a descending section, a loop section and a helix section.

* * * * *